US005300990A

United States Patent [19]

Thompson

[11] Patent Number: 5,300,990

[45] Date of Patent: Apr. 5, 1994

[54] LIQUID ELECTROPHOTOGRAPHIC PRINTER DEVELOPER

[75] Inventor: John A. Thompson, Boise, Id.

[73] Assignee: Hewlett-Packard Company, Palo Alto, Calif.

[21] Appl. No.: 904,798

[22] Filed: Jun. 26, 1992

[51] Int. Cl.[5] ..... G03G 15/10

[52] U.S. Cl. ..... 355/256; 118/661; 355/260; 430/112

[58] Field of Search ..... 355/256, 260; 118/660, 118/661, 659, 651, 647; 430/115, 112, 113, 118, 119

[56] References Cited

U.S. PATENT DOCUMENTS

| | | | |
|---|---|---|---|
| 3,788,995 | 1/1974 | Stably et al. | 252/62.1 |
| 3,955,533 | 5/1976 | Smith et al. | 118/637 |
| 3,957,016 | 5/1976 | Yamada et al. | 118/637 |
| 4,286,039 | 8/1981 | Landa et al. | 430/119 |
| 4,325,627 | 4/1982 | Swidler et al. | 118/651 X |
| 4,860,050 | 8/1989 | Kurotori et al. | 355/256 |
| 4,974,027 | 11/1990 | Landa et al. | 355/256 |
| 4,999,677 | 3/1991 | Landa et al. | 355/273 |
| 5,028,964 | 7/1991 | Landa et al. | 355/256 X |

*Primary Examiner*—A. T. Grimley

*Assistant Examiner*—Thu Dang

[57] ABSTRACT

The invention is a liquid toner developer for a laser printer. There is an open bath of liquid toner about 50 microns below a moving outer bottom photoconductor surface energized by actinic light. Immediately downstream of the liquid bath and adjacent to it is a charged, reverse direction developer roller, also about 50 microns below the photoconductor surface. Downstream of the developer roller, and in relatively close spaced-apart relationship from it, is a same direction rigidizing/squeegee roller charged about the same as the developer roller. A blade lies close to or in contact with the rigidizing/squeegee roller slightly upstream of its nip point to provide a drain path along the length of the roller to aid excess toner removal from the roller. A common wiping means cleans both the developer and the rigidizing/squeegee rollers, and directs excess toner into a recycle system to save toner supply and replenish the bath of liquid toner. The image on the photoconductor surface leaving the developer system is very dry, and suitable for direct transfer to a sheet of paper. In a preferred embodiment, a series of the developer systems with different color toners are employed to create a multi-color image on the paper.

20 Claims, 3 Drawing Sheets

LIQUID ELECTROPHOTOGRAPHIC PRINTER DEVELOPER

BACKGROUND OF THE INVENTION

1. Technical Field

This invention relates generally to image transfer technology, and more specifically to electrophotography. I have invented a laser printer developer which may be used to produce multi-color images with liquid toners.

2. Background Art

In electrophotography, a latent image is created on the surface of an insulating, photo-conducting material by selectively exposing areas of the surface to light. A difference in electrostatic charge density is created between the areas on the surface exposed and unexposed to light. The visible image is developed by electrostatic toners containing pigment components dispersed in an insulating carrier liquid. The toners are selectively attracted to the photoconductor surface either exposed or unexposed to light, depending on the relative electrostatic charges of the photoconductor surface, development electrode and the toner. The photoconductor may be either positively or negatively charged, and the toner system similarly may contain negatively or positively charged particles. For laser printers, the preferred embodiment is that the photoconductor and toner have the same polarity.

A sheet of paper or intermediate transfer medium is given an electrostatic charge opposite that of the toner and passed closed to the photoconductor surface, pulling the toner from the photoconductor surface onto the paper or intermediate medium still in the pattern of the image developed from the photoconductor surface. Thermal energy may also be used to assist transfer of the image to paper or intermediate transfer medium. A set of fuser rollers melts and fixes the toner in the paper, for the case where no thermal transfer is used, subsequent to direct transfer or indirect transfer when using an intermediate transfer medium, producing the printed image.

There is a demand in the laser printer industry for multi-colored images. Responding to this demand, designers have turned to liquid toners, with pigment components and thermoplastic components dispersed in a liquid carrier medium, usually aliphatic hydrocarbon liquids. With liquid toners, it has been discovered, the basic printing colors—yellow, magenta, cyan and black, may be applied sequentially to a photoconductor surface, and from there to a sheet of paper or intermediate medium to produce a multi-colored image.

With liquid toners, however, there is a need to remove the liquid carrier medium from the photoconductor surface after the toner has been applied to it. This way, the photoconductor surface will not transfer the liquid carrier to the paper or to the intermediate medium in the image transfer step(s). Also, this way the liquid carrier may be recovered for recycle and reuse in the developer system, providing economy in terms of printing supplies, and eliminating environmental and health concerns from disposal of excess liquid carrier medium.

It is known from U.S. Pat. No. 3,955,533 to employ a reverse direction roller spaced about 50 microns (about 0.002 inches) from the photoconductor surface to shear off the carrier liquid and excess pigmented solids in the region beyond the outer edge of the image to leave relatively clean background areas on the photoconductor surface.

Also, from U.S. Pat. No. 3,957,016, it is known in a negative toner system to use a positive biased reverse roller maintained at a voltage intermediate the image and background voltages to help clean the background and compact the image on the photoconductor surface.

Also, from U.S. Pat. No. 4,286,039, it is known in a positive toner system to use a reverse roller followed by a negatively biased squeegee roller. The squeegee roller both compacts the latent image and removes excess carrier liquid.

U.S. Pat. Nos. 4,974,027 and 4,999,677 disclose a positively biased reverse roller followed by a negatively biased rigidizing roller followed by a squeegee roller, separate from the rigidizing roller, for removing excess carrier liquid from the image after rigidization. The charge on these rollers may be reversed if the charge on the toner is reversed. In these two patents, an intermediate transfer drum is downstream of the rigidizing roller for receiving the toner image from the photoconductor surface and transferring the image to a sheet of paper.

There is a need in the electrophotography industry then, for a liquid toner developer which provides a rigid latent image leaving the developer unit which is very dry and suitable for direct contact with the paper or intermediate transfer medium onto which the image will be transferred. Also, there is a need for a developer in which the developer roller and rigidizing or squeegee roller are in close proximity to provide a compact developer unit and to minimize any effect of electrostatic charge loss of the toner on the photoconductive surface between the two rollers. Also, there is a need to provide a liquid toner drain path along the length of the rigidizing/squeegee roller to aid excess toner removal from the roller. Also, there is a need for a developer in which the developer roller and rigidizing or squeegee roller are cleaned continuously of residual toner by a common cleaning means which is in contact with both the developer roller and the rigidizing or squeegee roller. Also, there is a need, if the common cleaning means above is a foam roller, for a squeeze rod/roller in contact with the foam roller for removal of toner and carrier liquid from it.

DISCLOSURE OF INVENTION

My invention is a liquid electrophotographic laser printer developer which has a moveable photoconductor surface with a positively charged latent image on it. The photoconductor surface may be a drum-type cylinder, but preferably, the photoconductor surface is a flat, thin rotating loop-type belt of photoconductor material. There is a liquid toner bath containing positively charged toner particles dispersed in a liquid carrier material, the toner bath having an open top surface which is in close proximity (approximately 50–75 microns, or 0.002–0.003 inches) to the outer bottom of the photoconductor surface for applying a thin film of toner to the photoconductor surface.

Slightly downstream of, adjacent to, or in direct contact with the liquid toner bath, in the direction of movement of the photoconductor surface, is a positively charged developer roller, the outer surface of which is also in close proximity (approximately 50–75 microns, or 0.002–0.003 inches) to the outer bottom of the photoconductor surface, the developer roller being rotatable so that its outer surface moves in the opposite direction of movement of the photoconductor surface for removing excess toner and carrier material from the photoconductor surface. Preferably, the charge on the outer surface of the developer roller is between about (+) 300–400 volts. Also, preferably, the speed of the outer surface of the developer roller is about 3 times the speed of the photo-conductor surface. Downstream from the developer roller, and in relatively close relationship to it, is a positively charged rigidizing/-squeegee roller in contact with the outer bottom surface of the photoconductor surface. The rigidizing/squeegee roller is rotatable so that its outer surface moves in the same direction of movement of, and at the same speed as, the photoconductor surface for removing residual carrier material from the photoconductor surface. Preferably, the rigidizing/squeegee roller is not driven, but instead rides with the movement of the photoconductor surface. Also, preferably, the rigidizing/squeegee roller is made of a conductive rubber material with a resistivity of approximately $10^8$ ohm-cm, and is maintained at about the same positive charge as the toner, about (+) 300–400 volts at the outer surface of the roller. Also, preferably, the rigidizing/squeegee roller is located so that its point of contact, or nip, with the photo-conductive surface is close to the closest point of contact, or nip, of the developer roller. This way, the charge on the rigidizing/squeegee roller is able to repel and compact toner on the latent image of the photoconductor surface, and remove excess toner, as well as excess liquid carrier, from the photoconductor surface before the charge of the toner breaks down or dissipates. Preferably, the distance between the nip of the rigidizing/-squeegee roller and the nip of the developer roller is minimized for compactness and to minimize the time between toner deposition and rigidizing-squeegeeing of the image.

Beneath the developer roller and the rigidizing/-squeegee roller is a common wiping means in contact with both the developer roller and the rigidizing/-squeegee roller to clean and remove residual toner and liquid carrier material from both rollers. The common wiping means may be a scraper blade in contact with both rollers, but it is preferably a conductive, rubber foam wiper roller with a charge maintained at electrostatically less than the positive charge on the developer and rigidizing/squeegee rollers in order to attract residual, positively charged toner from both rollers.

Finally, beneath the photoconductor surface and all the rollers is a means for recycling toner and liquid carrier material drained to the bottom of the system, or removed by the common wiper means, to the liquid bath. This recycle means will have a drain, reservoir and recycle pump which are all preferably separate from, or external to, a cartridge container for the liquid toner bath, developer roller, rigidizing/squeegee roller and common wiping means.

In a preferred embodiment of my invention, four separate cartridges containing my liquid developer system are provided in series along the direction of movement of the photoconductor surface, one each for the colors yellow, magenta, cyan and black, in that order. This way, successive, different color images may be developed on the photoconductor surface, and transferred at one time to a sheet of paper or other intermediate medium, ultimately creating a multicolor printed image on the paper.

BEST MODE FOR CARRYING OUT INVENTION

Figure 1:
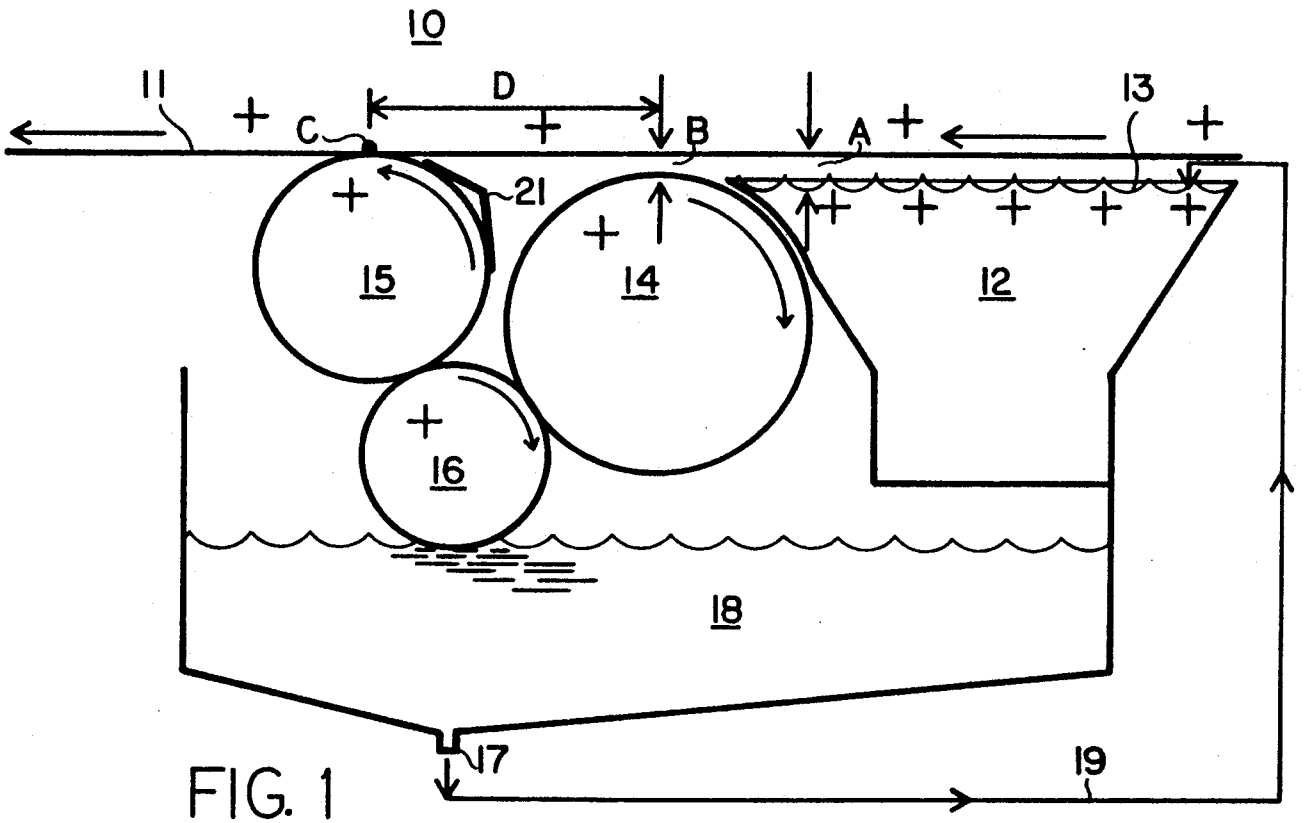
FIG. 1 is a schematic diagram of one embodiment of the printer developer of my invention with the common wiping means being a rubber foam wiper roller.

Referring to the figures, there is depicted generally my printer developer 10 with movable photoconductor surface 11 with a positively charged latent image on it. The direction of movement of the photoconductor surface is indicated by the arrow. Liquid toner bath 12 contains positively charged toner particles dispersed in a liquid carrier material. Toner bath 12 has open top surface 13 which is in close proximity to the photoconductor surface 11 for applying a thin film of toner to it. Preferably, photoconductor surface 11 is a flat, thin rotating loop-type belt of photoconductor material. Organic, polymeric photoconductor materials are preferred, due to their economy. The photoconductor materials may contain an outer layer of photoconductive pigments dispersed in a binder material. The photoconductor outer surface may be overcoated with a low activation energy coating material, or the binder material itself may be a low activation energy material.

The liquid toner is comprised of an insulating carrier liquid, "toner" particles, charge control agent, and additional additives as may be necessary to obtain desired image quality and image integrity. Such additives may, for example, include antistatic agents, plasticizer, leveling additives, dispersants, surfactants and other components added to the developer composition in order to improve the development and transfer characteristics of the toner. These additives may be incorporated into either the toner particle or dissolved or dispersed in the carrier liquid. Such additives are known to those skilled in the art to which the invention pertains; however, this list of toner additives is provided for illustration, and is not intended to limit the scope of the invention.

The carrier liquid may be selected from a wide variety of materials which are known in the art. The liquid is typically oleophilic, chemically stable under a variety of conditions, and electrically insulating. By electrically insulating we mean that the liquid has a low dielectric constant and a high electrical resistivity. Preferably, the carrier liquid has a dielectric constant of less than 5; more preferably less than 3. Examples of suitable carrier liquids include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like), silicone oils and blends of these solvents. Preferred carrier liquids include paraffinic solvent blends sold under the names Isopar G, Isopar H, Isopar K and Isopar L (trademarks of Exxon Corporation); the most preferred carrier liquid is sold under the name Norpar 12 (trademark of Exxon Corporation). The foregoing list is intended as merely illustrative of the carrier liquids which may be used in conjunction with the present invention, and is not in any way intended to limit the scope of this invention.

The toner particles are comprised of colorant embedded in a thermoplastic resin core. The colorant may be a dye or more preferably a pigment. The resin may be comprised of one or more polymers or copolymers which are characterized as being generally insoluble or only slightly soluble in the carrier liquid; these polymers or copolymers comprise a resin core. In addition, superior stability of the dispersed toner particles with respect to aggregation is obtained when at least one of the polymers or copolymers (denoted as the stabilizer) is an amphipathic substance containing at least one chain-like component of molecular weight at least 500 which is solvated by the carrier liquid. By this we mean that the selected stabilizer, if present as an independent molecule, would have some finite solubility in the carrier liquid such that the carrier liquid is considerably better than a theta solvent as discussed in "Polymer Handbook" (Ed. Brandrup and Immergut, Interscience, 1966). Under such conditions, the stabilizer extends from the resin core into the carrier liquid, acting as a steric stabilizer as discussed in "Dispersion Polymerization" (Ed/Barrett, Interscience. 1975, p. 9). The stabilizer may be chemically incorporated into the resin core (i.e. grafted to the core) or may be physically or chemically adsorbed to the core such that it remains as an integral part of the resin core.

Examples of resin materials suitable for use in the liquid developer composition include polymers and copolymers of methyl acrylate, ethyl acrylate, butyl acrylate, ethylhexyl acrylate, lauryl acrylate, octadecyl acrylate, methyl(methacrylate), ethyl(methacrylate), lauryl methacrylate, hydroxy(ethylmethacrylate), octadecyl (methacrylate) and other polyacrylates. Other polymers may be used either alone or in conjunction with the aforementioned materials, including melamine and melamine formaldehyde resins, phenol formaldehyde resins, epoxy resins, polyester resins, styrene and styrene/acrylic copolymers, acrylic and methacrylic esters, cellulose acetate and cellulose acetate-butyrate copolymers, and poly(vinyl butyryl) copolymers. The foregoing list is intended as merely illustrative of the polymers and copolymers comprising toner particles which may be used in conjunction with the present invention, and is not in any way intended to limit the scope of this invention.

The colorants which may be used include virtually any dyes, stains or pigments which may be incorporated into the polymer resin, which are compatible with the carrier liquid, and which are useful and effective in making visible the latent electrostatic image. Examples of suitable colorants include: Phthalocyanine blue (C.I. Pigment Blue 15 and 16), Quinacridone magenta (D.I. Pigment Red 122, 192, 202 and 206), diarylide (benzidine) yellow (C.I. Pigment Yellow 12, 13, 14, 17, 55, 83 and 155) and arylamide (Hansa) yellow (C.I. Pigment Yellow 1, 3, 10, 73, 74, 97, 105 and 111); organic dyes, and black materials such as finely divided carbon and the like. The foregoing list is intended as merely illustrative of the colorants incorporated into toner particles which may be used in conjunction with the present invention, and is not in any way intended to limit the scope of this invention.

The optimal weight ratio of resin to colorant in the toner particles is on the order of 1/1 to 20/1, most between 10/1 and 3/1. The total dispersed material in the carrier liquid typically represents 0.5 to 20 weight percent, most preferably between 0.5 and 3 weight percent of the total liquid developer composition.

The developer composition includes a charge control agent, sometimes referred to as a charge director, to provide uniform charge polarity of the toner particles. The charge director may be incorporated into the toner particles, may be chemically reacted to the toner particle, may be chemically or physically adsorbed onto the toner particle (resin or pigment), and may be chelated to a functional group incorporated into the toner particle, preferably via a functional group comprising the stabilizer. The charge director acts to impart an electrical charge of selected polarity (either positive or negative) to the toner particles. Any number of charge directors described in the art may be used herein; preferred positive charge directors are the metallic soaps (U.S. Pat. No. 3,411,936 to Kotsman et al.), most preferred are polyvalent metal soaps of zirconium and aluminum.

Preferably, toner bath top surface 13 is within about 50–75 microns (0.002–0.003 inches) from the bottom outer surface of photo-conductor surface 11. This distance is represented by letter "A" in the Figures. This way, an adequate supply of the positively charged toner is available to provide an ample film of the toner on the discharged areas of the photoconductor surface by means of an induced electrostatic attraction between them, due to the positive electrostatic bias of the developer roller.

Slightly downstream of, adjacent to, or in direct contact with, the toner bath 12, in the direction of movement of the photoconductor surface 11, is a positively biased developer roller 14. The top outer surface of developer roller 14 is in close proximity to the bottom outer surface of the photoconductor surface 11. Preferably, developer roller 14's top outer surface is within about 50–75 microns (0.002–0.003 inches) from the bottom outer surface of photoconductor surface 11. This distance is represented by letter "B" in the figures. Developer roller 14 rotates in a direction opposite the movement of photoconductor surface 11. My studies confirm that the velocity of the outer surface of developer roller 14 should be about 3 times the velocity of the photoconductor surface. This way, a substantial shear force is exerted on the toner and carrier liquid film in the area of the nip of the developer roller 14, minimizing the film thickness of toner and carrier liquid on photoconductor surface 11 downstream of developer roller 14.

Also, the charge on the outer surface of developer roller 14 is beneath and maintained at between about (+) 400–500 volts. This way, positive charge on the developer roller 14 repels the positive charge in the toner to the discharged areas of the photoconductor surface, and attracts toner in the charged areas of the photoconductor surface. This electrophoretic development minimizes toner in the background regions and maximizes toner deposition in the image areas.

Preferably, developer roller 14 has a diameter of 20–30 mm. The smaller diameter roller is preferred in order to minimize the size of the developer system. However, the larger diameter roller is preferred in order to maximize the "effective footprint" size between the photoconductor surface and developer roller 14. The larger the "footprint", which is the region in which electrical fields are effective for deposition of toner, the more development time, and, consequently, the more dense the resultant image. Therefore, there is a trade-off in the selection of developer roller 14 diameter.

A positively charged rigidizing/squeegee roller 15 in contact on its top outer surface with the photoconductor surface 11 is located downstream of the developer roller 14. By "in contact with", I mean the rigidizing/squeegee roller 15 is pressed against the photoconductor surface 11, with a springed lever, for example. Due to fluid dynamic forces of the toner film on the photoconductor surface 11, I recognize there may be a slight physical separation, preferably less than about 1 micron, at the nip of the rigidizing/squeegee roller 15, represented by the letter "C" in the Figures. The rigidizing/squeegee roller 15 is beneath and rotatable in the same direction as movement of, and speed at the same speed as, the photoconductor surface 11. Preferably, the rigidizing/squeegee roller 15 is not driven, but rides instead with the movement of the photoconductor surface 11. This way, the rigidizing/squeegee roller 15 does not tend to smear the latent image on photoconductor surface 11.

Preferably, the rigidizing/squeegee roller 15 is made of a conductive rubber material with a resistivity of about $10^8$ Ohm-cm, and is maintained at about the same positive charge as the developer roller 14, between about (+) 300–500 volts at its outer surface. This way, electrostatic repulsion prevents rigidizing/squeegee roller 15 from removing any image toner already bound to the discharged photoconductor surface 11, while the pressed contact of the roller with the photoconductor surface 11 permits "squeegee-ing" as much excess liquid carrier material from the photoconductor as possible.

Also preferably, the rigidizing/squeegee roller 15 is located so that its nip is relatively close to the nip of developer roller 14. For a rigidizing/squeegee roller 15 of 15 mm diameter, a preferred size, and a developer roller 14 of 30 mm diameter, I prefer a distance between nips, represented as letter "D" in the Figures, of about 23 mm. That is, the rollers 14 and 15 are almost touching. Distance "D" is preferably minimized to avoid the problem of charge breakdown or dissipation in the bound image toner, resulting in loss of image integrity. There is a time constant for this phenomena, and the latent image is compacted and rigidized best by the roller 15 when distance "D" is minimized.

Optionally, an easily "wettable" blade 21 lies near or in contact with rigidizing/squeegee roller 15 slightly upstream of nip point C. Blade 21 is of a generally planar shape, with an obtuse bend near its middle. It is generally vertically disposed, with its upper edge extending as close as possible, without contacting, nip point C. Its bottom edge extends down alongside the outer surface of rigidizing/squeegee roller 15, allowing excess toner to drain down along its top surface and into the space between rigidizing/squeegee roller 15 and developer roller 14. Blade 21 aids in removal of excess liquid toner from the region of nip point C. If the film of liquid toner on the photoconductor surface is more than about 1 micron thick downstream of the nip point B of developer roller 14, then excess toner builds up, or "floods" at nip point C. At "flood" conditions, excess toner travels to the ends of rigidizing/squeegee roller 15, and at the longitudinal boundaries of the roller, wicks across the nip point C of the roller and becomes deposited on the photoconductor surface downstream of the nip point C, eliminating the benefit of the rigidizing/squeegee roller. Optional blade 21 helps prevent "flood" conditions by providing a convenient drain path along the length of rigidizing/squeegee roller 15.

Beneath the developer roller 14 and the rigidizing/squeegee roller 15 is a common wiping means, 16 or 20, in contact with both developer roller 14 and rigidizing/squeegee roller 15. In FIG. 1 there is depicted an embodiment of my invention with the common wiping means being a rubber foam wiper roller 16. Preferably, wiper roller 16 is an electrically conductive foam which is electrically biased relative to the toner at a level less than the developer roller 14 and the rigidizing/squeegee roller 15 in order to attract and remove toner from both rolls for redispersion in toner recycle reservoir 18.

Preferably, wiper roller 16 rotates so that it's outer surface moves in the direction opposite the direction of movement of the outer surface of developer roller 14, and in the same direction as movement of the outer surface of rigidizing/squeegee roller 15. Also, preferably wiper roller 16 rotates so that the speed of its outer surface is different than the speed of developer roller 14's outer surface, and also different than the speed of rigidizing/squeegee roller 15's outer surface. This way, the speed differences at the nips between these rollers create shear forces which assist in cleaning and removing residual toner and carrier liquid from both developer roller 14 and rigidizing/squeegee 15.

When foam wiper roller 16 is used, preferably squeeze rod/roller 22 is also used. Squeeze rod/roller 22 lies parallel to the surface of, and is pressed firmly against, foam roller 16 for removal of toner and carrier liquid from it.

Figure 2:
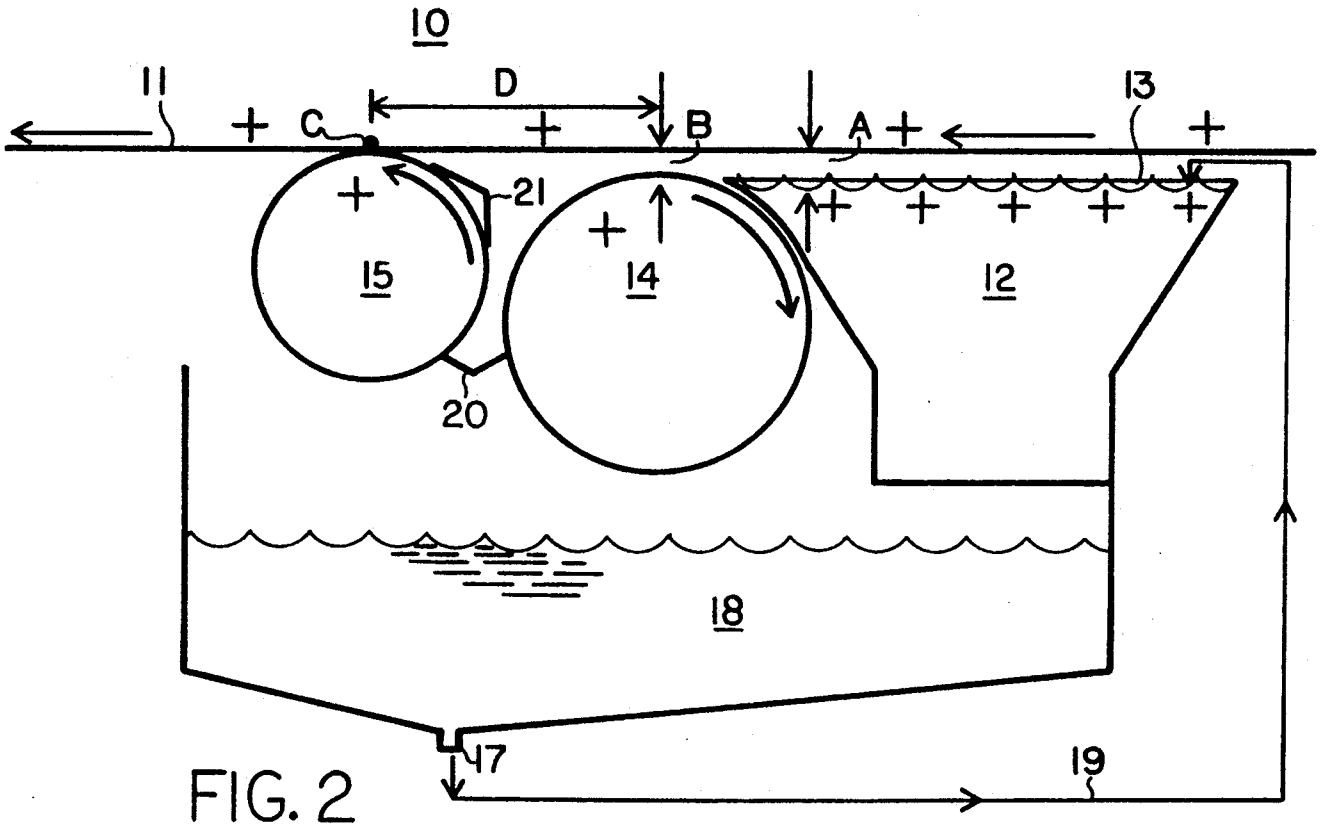
FIG. 2 is a schematic diagram of a different embodiment of my invention with the common wiping means being a scraper blade.

The common wiping means may also be a scraper blade 20 in contact with both rollers as depicted in FIG. 2. Scraper blade 20 has drain means built into it for allowing removed toner and carrier liquid to drain into toner recycle reservoir 18. However, foam wiper roller 16 is preferred because it does not create "toner debris" which is an undesirable consequence of scraping.

Beneath the photoconductor surface 11 and the rollers 14, 15 and 16, is a means for recycling toner and carrier liquid collected in reservoir 18 to the toner bath 12. This way, the excess toner and carrier liquid may be recovered and reused. Generally, this recycle means will have a drain 17 at the bottom of reservoir 18, and a pump in line 19 to collect and return the excess toner and carrier liquid to toner bath 12. Preferably, when my developer system is manufactured and assembled in a cartridge format for the toner bath 12, developer roller 14, rigidizing/squeegee roller 15 and wiper roller 16 or scraper 20, the recycle means is external to the cartridge. This way, the cartridge may be compact, and conveniently changed out for repair or replacement.

Figure 3:
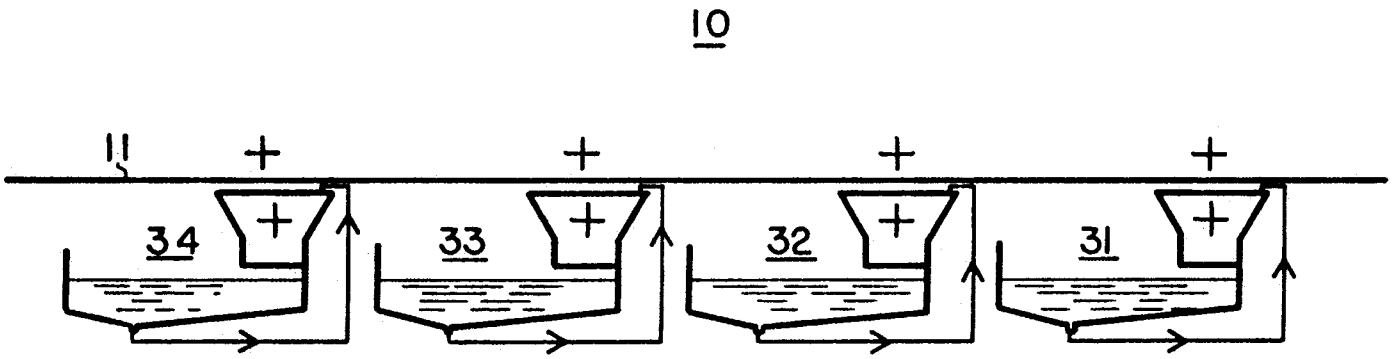
FIG. 3 is a schematic diagram of an embodiment of my invention with four separate different color cartridges provided in series along the direction of movement of the photoconductor surface.

In a preferred embodiment of my invention, depicted schematically in FIG. 3, four separate cartridges 31–34 containing my developer system are provided in series along the direction of movement of the photoconductor surface 11. Each developer cartridge contains toner for a different color—yellow, magenta, cyan and black, and they are provided in that order in the direction of movement of the photoconductor surface 11. This way, successive, different color latent images may be developed on the photoconductor surface 11, and transferred at one time to a sheet of paper or intermediate transfer medium, ultimately creating a multi-color printed image on the paper. Also, overlapping different colors, or "overtoning" may be done, creating different colors and shades of different colors on the final printed image. With my developer system, a very dry latent image is created on the photoconductor surface, allowing subsequent, successive latent images of different colors and even overtoning of two colors. Also, with my developer system the latent image may be directly transferred to paper, or to an intermediate medium and then to paper without concern of excessive carrier liquid carry-out by the paper. Also, with my developer system there is no need to provide a separate, external dryer for removing excess carrier liquid.

While there is shown and described the present preferred embodiment of the invention, it is to be distinctly understood that this invention is not limited thereto but may be variously embodied to practice within the scope of the following claims.

I claim:

1. A liquid electrophotographic printer developer system comprising:

a moveable, photoconductor surface with an outer bottom surface having a positively charged latent image on it, said outer bottom surface moving in a first direction at a first speed;

a liquid toner bath containing positively charged toner particles dispersed in a liquid carrier material, the liquid toner bath having an open top surface which is beneath and within about 50–75 microns from the outer bottom of the photoconductor surface, for applying toner to the photoconductor surface;

a positively charged developer roller with an outer surface, the said developer roller being slightly downstream of the liquid toner bath in the said first direction of movement of the photoconductor surface, and adjacent to liquid toner bath, the outer surface of said developer roller also being beneath and in close proximity to the outer bottom of the photoconductor surface, said developer roller being rotatable in a second direction opposite the said first direction of movement of the photoconductor surface at a second speed for removing excess toner particles and liquid carrier material from the photoconductor surface;

a positively charged rigidizing/squeegee roller with an outer surface, the said rigidizing/squeegee roller being downstream from the said developer roller and in relatively close spaced-apart relationship from it, the outer surface of the said rigidizing/squeegee roller being beneath and in contact with the outer bottom of the photoconductor surface, said rigidizing/squeegee roller being rotatable in the same said first direction of movement of, and at the same said first speed as, the photoconductor surface, for removing residual liquid carrier material from the photoconductor surface;

a common wiping means, in contact with both the said developer roller and the said rigidizing/squeegee roller to remove residual toner and liquid carrier material from both said developer roller and said rigidizing/squeegee roller; and a recycle means beneath the photoconductor surface, the said developer roller, the said rigidizing/squeegee roller and the common wiping means for receiving excess toner and liquid carrier material for recycling toner and liquid carrier material to the liquid toner bath.

2. The developer system of claim 1 wherein the photoconductor surface is a flat, thin rotating loop-type belt of photoconductor material.

3. The developer system of claim 1 wherein the open top surface of the liquid toner bath is approximately 50 microns from the bottom outer surface of the photoconductor surface.

4. The developer system of claim 1 wherein the outer surface of the developer roller is approximately 50 microns from the bottom outer surface of the photoconductor surface.

5. The developer system of claim 1 wherein the charge on the outer surface of the developer roller is from about 400 to about 500 volts.

6. The developer system of claim 1 wherein the said second speed of the outer surface of the said developer roller is about 3 times the said first speed of the photoconductor surface.

7. The developer system of claim 1 wherein the rigidizing/squeegee roller is not driven, but rides instead with the movement of the photoconductor surface.

8. The developer system of claim 1 wherein the rigidizing/squeegee roller is made of a conductive rubber material with a resistivity of about $10^8$ Ohm-cm.

9. The developer system of claim 1 wherein the outer surface of the said rigidizing/squeegee roller has a positive charge which is from about 300 to about 500 volts.

10. The developer system of claim 1 wherein a blade lies close to the outer surface of the said rigidizing/squeegee roller, slightly upstream of its nip point, to produce a drain path along the outer surface of the said rigidizing squeegee roller to aid excess toner removal from the said rigidizing squeegee roller.

11. The developer system of claim 1 wherein the common wiping means is a scraper blade in contact with both the developer and the rigidizing/squeegee rollers.

12. The developer system of claim 1 wherein the common wiping means is a conductive, foam wiper roller in contact with both the developer and the rigidizing/squeegee rollers.

13. The developer system of claim 12 wherein the wiper roller has a charge maintained at less than the charge on the developer and rigidizing/squeegee rollers in order to attract residual toner from both rollers.

14. The developer system of claim 12 which also comprises a squeeze rod/roller in contact with the foam wiper roller for removal of toner and carrier liquid from it.

15. The developer system of claim 1 wherein the recycle means comprises a reservoir and a recycle pump which are all external to a cartridge container for the liquid toner bath, developer roller, rigidizing/squeegee roller and common wiping means.

16. The developer system of claim 1 wherein a plurality of separate cartridges containing the liquid toner bath, developer roller, rigidizing/squeegee roller, common wiping means and recycle means are provided in series along the direction of movement of the photoconductor surface.

17. The developer system of claim 16 wherein each cartridge has a different color toner.

18. The developer system of claim 17 wherein four (4) separate cartridges are provided.

19. The developer system of claim 18 wherein the colors are yellow, magenta, cyan and black.

20. The developer system of claim 19 wherein the cartridges for the colors are arranged in sequential order of yellow, magenta, cyan and black in the said first direction of movement of the photoconductor surface.

* * * * *